US009802780B2

(12) United States Patent
Kobayashi

(10) Patent No.: US 9,802,780 B2
(45) Date of Patent: Oct. 31, 2017

(54) APPARATUS FOR COLLECTING SHEETS AND APPARATUS FOR FORMING IMAGES

(71) Applicant: Misao Kobayashi, Kofu (JP)

(72) Inventor: Misao Kobayashi, Kofu (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/336,102

(22) Filed: Oct. 27, 2016

(65) Prior Publication Data

US 2017/0121143 A1 May 4, 2017

(30) Foreign Application Priority Data

Oct. 30, 2015 (JP) ..... 2015-213814

(51) Int. Cl.

| | |
|---|---|
| ***B65H 31/04*** | (2006.01) |
| ***B65H 31/22*** | (2006.01) |
| ***B65H 31/18*** | (2006.01) |
| ***G03G 15/00*** | (2006.01) |
| ***B65H 31/10*** | (2006.01) |
| ***B65H 31/20*** | (2006.01) |

(52) U.S. Cl.

CPC ..... *B65H 31/04* (2013.01); *B65H 31/10* (2013.01); *B65H 31/18* (2013.01); *B65H 31/20* (2013.01); *B65H 31/22* (2013.01); *G03G 15/6529* (2013.01); *G03G 15/6552* (2013.01); *B65H 2402/10* (2013.01); *B65H 2403/41* (2013.01); *B65H 2405/11164* (2013.01); *B65H 2553/612* (2013.01); *B65H 2801/06* (2013.01)

(58) Field of Classification Search

CPC ..... B65H 31/22; B65H 31/10; B65H 31/18; B65H 31/04; B65H 31/24

See application file for complete search history.

(56) References Cited

U.S. PATENT DOCUMENTS

| | | | | |
|---|---|---|---|---|
| 6,736,393 B2 * | 5/2004 | Noh | ..... | B65H 31/10 271/214 |
| 2015/0050060 A1 * | 2/2015 | Kim | ..... | B65H 31/02 399/407 |

FOREIGN PATENT DOCUMENTS

| | | | |
|---|---|---|---|
| JP | 2008114941 A | * | 5/2008 |
| JP | 2013049496 A | * | 3/2013 |
| JP | 2014-106294 A | | 6/2014 |
| JP | 5763893 B2 | | 8/2015 |
| JP | 5763898 B2 | | 8/2015 |

* cited by examiner

*Primary Examiner* — Luis A Gonzalez
(74) *Attorney, Agent, or Firm* — Manabu Kanesaka

(57) ABSTRACT

Provided is an apparatus provided with a collection tray for receiving a discharged sheet and shifting, a discharge unit (binding unit constituting a part of a sheet processing apparatus) for discharging a sheet, a shift rail (up-and-down rail including an up-and-down rack) provided in the discharge unit to permit a shift of the collection tray corresponding to a sheet collection amount of the collection tray, a drive member (up-and-down motor) that shifts the collection tray along the shift rail, and an extension rail capable of being added and set onto the shift rail to extend a shift range of the collection tray. By this means, it is possible to increase a collection amount of sheets relatively with ease.

10 Claims, 11 Drawing Sheets

APPARATUS FOR COLLECTING SHEETS AND APPARATUS FOR FORMING IMAGES

BACKGROUND OF THE INVENTION

1. Field of the Invention

The present invention relates to a sheet collection apparatus for collecting sheets discharged from an image formation apparatus such as a copier and various types of printers, and more particularly, to a sheet collection apparatus capable of increasing a collection amount of discharged sheets.

2. Description of the Related Art

Generally, it is known widely to collect sheets after performing sheet folding processing and/or sheet binding processing on sheets carried out of an image formation apparatus or without performing such processing.

In addition, in recent years, it has been required to downsize the image formation apparatus and sheet collection apparatus including sheet processing attached to the image formation apparatus. In order to respond to the requirement, an apparatus is proposed where the sheet collection apparatus is disposed above the image formation apparatus after processing sheets.

For example, in Japanese Patent Gazette No. 5763898, an image formation section and space above the section is provided, a reading section for reading an original document is disposed above the space, a sheet collection apparatus including a sheet post-processing section for binding sheets is disposed in the space, and it is thereby intended to reduce the size of the entire image formation apparatus.

The sheet collection apparatus disposed in the space performs post-processing such as punch processing and binding processing on sheets discharged from a discharge roller of the image formation section, and then, stores processed sheets on a collection tray.

For the collection tray, as shown in FIG. 9 of Japanese Patent Gazette No. 5763898, since the sheet collection apparatus is disposed in the above-mentioned space, as compared with the conventional case of attaching the sheet collection apparatus to the side portion of the image formation apparatus, the protruding amount is small, and the apparatus is downsized. The collection tray is capable of storing sheets without undergoing punching or binding.

Further, also in Japanese Patent Application Publication No. 2014-106294, as shown in FIGS. 5 and 6 of the document, the sheet collection apparatus having a sheet discharge tray to perform post-processing is disposed in space between the image formation section and the original document reading section. Also in this apparatus, since all portions for performing binding processing are positioned above the image formation section, a portion protruding to the side of the apparatus is small, and downsizing is attained.

In sheet storage apparatuses shown in the above-mentioned Japanese Patent Gazette No. 5763898 and Japanese Patent Application Publication No. 2014-106294, since a discharge unit that is a sheet processing section is installed above the image formation section, an up-and-down range of the collection tray (sheet discharge tray) is limited to a range above the image formation section positioned to the side of the sheet processing section, and generally, a collection amount is limited to above 500 sheets to 1500 sheets. Accordingly, in order to increase a collection amount of the collection tray as required recently, it is necessary to replace with the sheet collection apparatus having the sheet processing section in the side portion of the image formation apparatus, which has conventionally existed.

However, it imposes significant loads economically and ought to be abandoned replacing with the entire apparatus so as to increase the collection amount on the collection tray by about 500 sheets to 1000 sheets.

SUMMARY OF THE INVENTION

It is an object of the present invention to provide a sheet collection apparatus capable of increasing a collection amount of sheets relatively with ease and an image formation apparatus provided with the sheet collection apparatus, by expanding a range of an up-and-down shift of a collection tray to increase the collection amount of sheets relatively with ease, while using a sheet discharge tray unit previously used to perform sheet processing, without replacing with another apparatus.

In order to attain the above-mentioned object, according to the disclosure of the present invention, an apparatus is provided with a collection tray for receiving a discharged sheet and shifting, a discharge unit for discharging a sheet, a shift rail that is provided in the discharge unit and that permits a shift of the collection tray corresponding to a sheet collection amount of the collection tray, a drive member that shifts the collection tray along the shift rail, and an extension rail capable of being added and set onto the shift rail to extend a shift range of the collection tray.

According to the above-mentioned disclosure of the invention, by setting the extension rail that extends the shift range of the collection tray on the shift rail that permits a shift of the collection tray, it is possible to provide the sheet collection apparatus capable of expanding the range of the up-and-down shift of the collection tray relatively with ease and increasing the collection amount of sheets, and the image formation apparatus provided with the sheet collection apparatus.

BRIEF DESCRIPTION OF THE DRAWINGS

FIG. 9A is an internal mechanism explanatory view of the extension rail, and FIG. 9B is an explanatory view of a load reduction member incorporated into the extension rail;

FIG. 10A is an explanatory view where the rail engages in concave portions of the discharge unit to be attached, and FIG. 10B is an explanatory view where the extension rail is attached to only the image formation apparatus.

DESCRIPTION OF THE EMBODIMENTS

Figure 1:
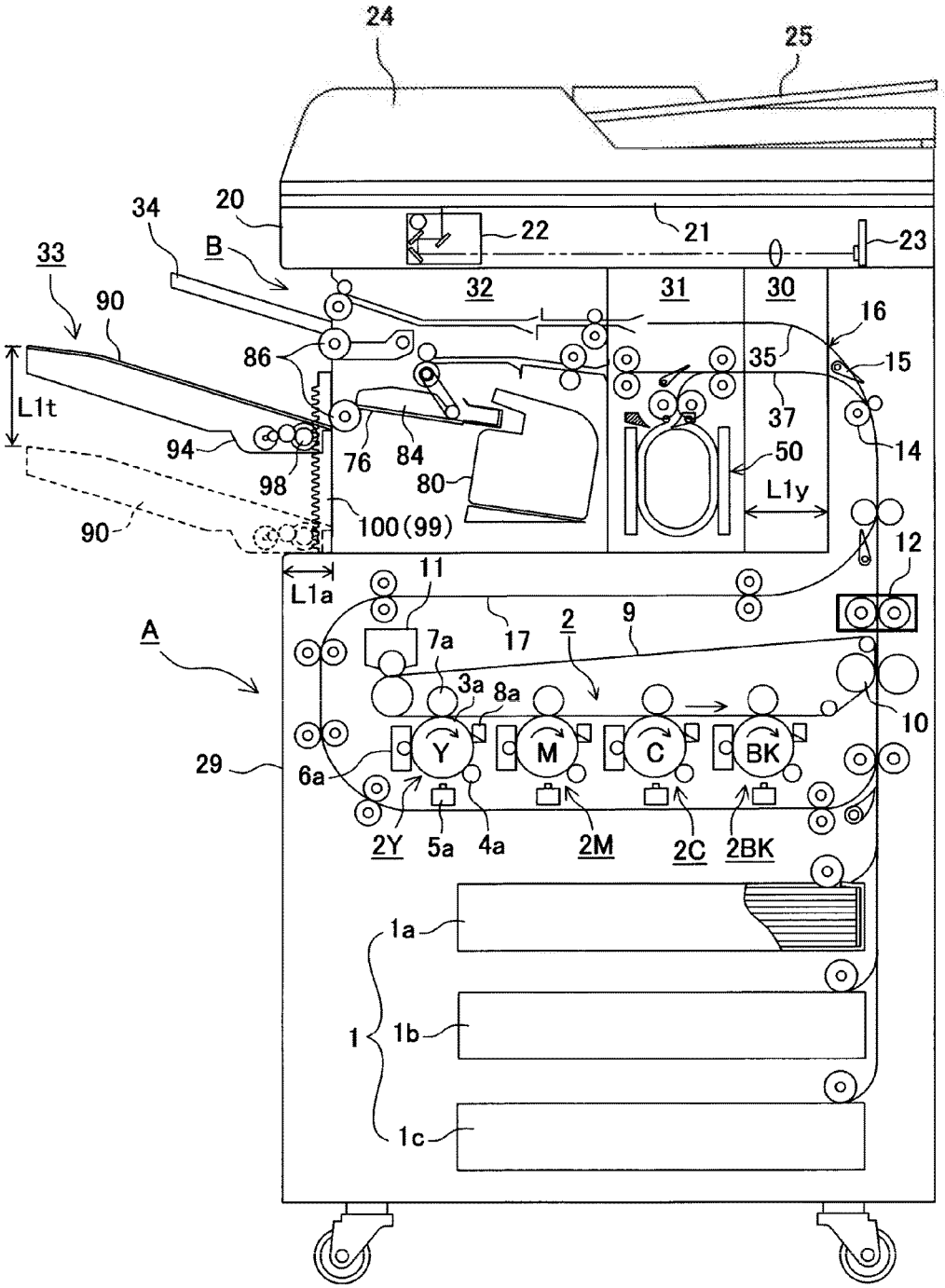
FIG. 1 is an explanatory view illustrating an entire configuration with an image formation apparatus and discharge unit combined.
Figure 2:
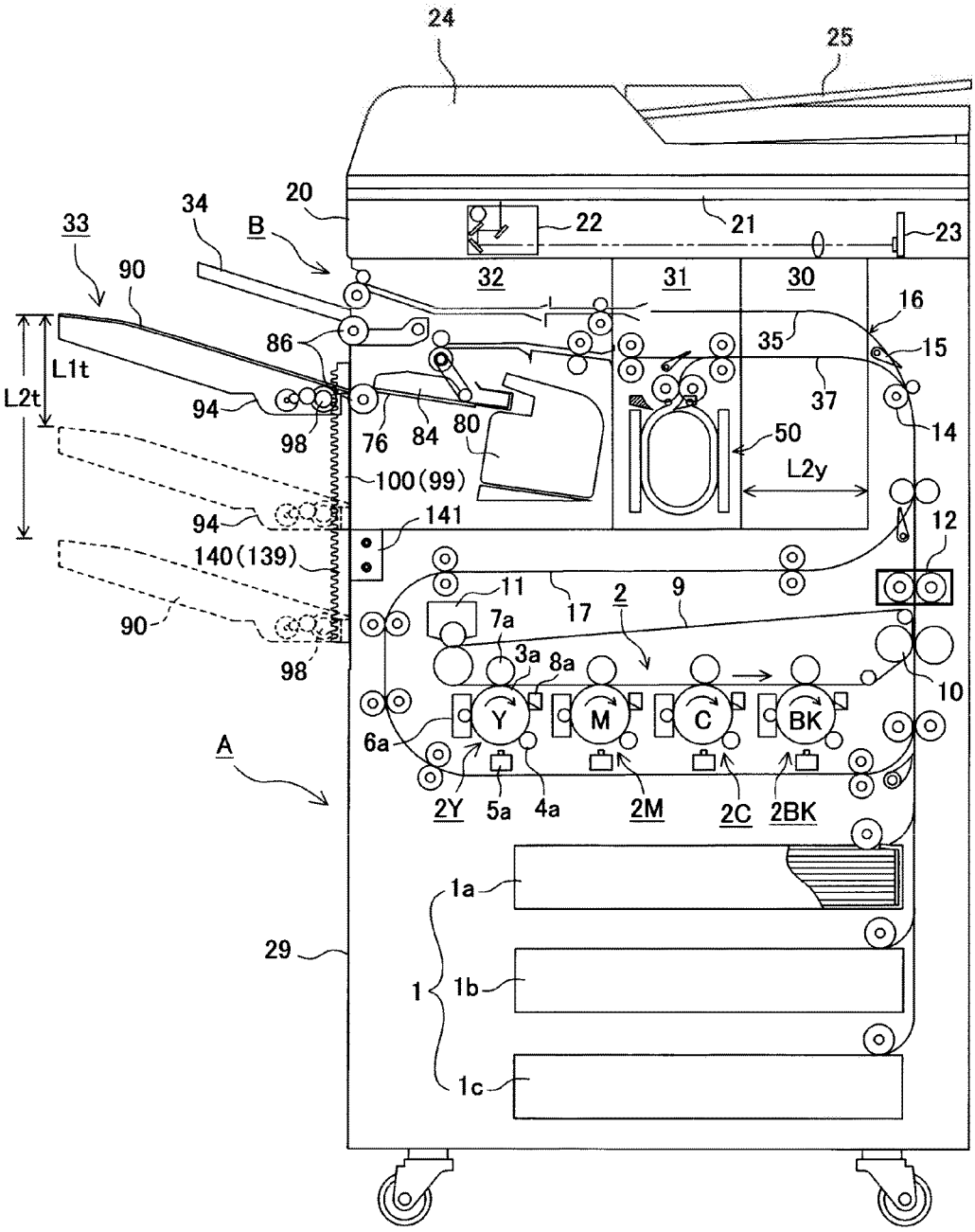
FIG. 2 is an explanatory view illustrating an entire configuration with a discharge unit that extends an up-and-down range of a collection tray according to the present invention and the image formation apparatus combined.

Referring to drawings, described below are a sheet processing apparatus B as a discharge unit according to the present invention, and an image formation apparatus A to attach the apparatus B. FIG. 1 is an explanatory view illustrating an entire configuration with the image formation apparatus A and sheet processing apparatus B combined. FIG. 2 is an explanatory view illustrating an entire configuration with the sheet processing apparatus B with an up-and-down range of a collection tray 90 extended according to the present invention and the image formation apparatus A combined.

[Image Formation Apparatus A]

The image formation apparatus A shown in FIGS. 1 and 2 uses an electrophotographic scheme, and a paper feed section comprised of three-stage paper feed cassettes 1*a*, 1*b*, 1*c* to store sheets is disposed below an image formation section 2. When the sheet processing apparatus B is not inserted, space above the image formation section 2 is sheet discharge space, and an image reading apparatus 20 is disposed above the space. Accordingly, when the sheet processing apparatus B is disposed, the apparatus is the so-called in-body type using the sheet discharge space.

The image formation section 2 adopts a tandem scheme using an intermediate transfer belt. In other words, color components of four colors (yellow 2Y, magenta 2M, cyan 2C and black 2BK) are used. For example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image. Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. This configuration is first-transferred to the intermediate transfer belt for each color component. The color component left on the photoconductor drum 3*a* is collected by a photoconductor cleaner 8*a* to prepare for next image formation. These schemes are the same as in the other color components as shown in FIGS. 1 and 2.

In addition, an image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner 11 to prepare for next transfer.

Thus image-formed sheet is fed to a main-body discharge outlet 16 by a main-body discharge roller 14. When image formation is performed on both sides of a sheet, the sheet once transported to the sheet processing apparatus B side with a switch gate 15 is switched back, transported to a circulation path 17, and is fed to the image formation section 2 again to form an image on the backside of the sheet.

The sheet with the image thus formed on one side or both sides is transported to the sheet processing apparatus B that is a discharge unit through the main-body discharge roller 14.

In addition, the image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter (for example, CCD) by irradiating using a scan unit 22, and the image is stored in a data storage section not shown. The stored image is formed on the sheet in the image formation section as described above.

[Sheet Processing Apparatus B]

Described next is the sheet processing apparatus B disposed in the sheet discharge space below the image reading apparatus 20, above the image formation section 2 of FIGS. 1 and 2. In the invention, the sheet processing apparatus B has the function of discharging sheets as a discharge unit.

In the sheet processing apparatus B are disposed a guide unit 30 for feeding a sheet discharged from the main-body sheet discharge outlet 16 to an apparatus on the downstream side or guiding a sheet undergoing switchback to form images on the both sides, a folding unit 31 for folding a sheet, for example, in three, a binding unit 32 for temporarily placing sequentially transported image-formed sheets on a processing tray 76 as a bunch to bind with a stapler 80, and a tray unit 33 as a sheet collection apparatus for collecting bunches of sheets bound by the binding unit 32 and sheets discharged without being bound and moving up and down.

In addition, the guide unit 30, folding unit 31, and binding unit 32 having the tray unit 33 constituting the sheet processing apparatus B as the discharge unit are capable of being disposed selectively, and for example, it is possible to place only the binding unit 32 or omit the folding unit 31.

In addition, in the tray unit 33 having the collection tray 90 that moves up and down, in FIG. 1, the collection tray 90 moves up and down with respect to an up-and-down rack 100, while the binding unit 32 is in a position on the inner side corresponding to L1*a* from a stay (outer frame side portion) of an apparatus frame 29 of the image formation apparatus A. Accordingly, since the sheet processing apparatus B is disposed in the sheet discharge space, the entire image formation apparatus A is made compact. Therefore, for example, when only the binding unit 32 is placed in the sheet discharge space, the collection tray 90 that moves up and down is also positioned in the sheet discharge space, and it is thereby possible to make the apparatus more compact.

On the other hand, in the apparatus shown in FIG. 1 in this case, a shift range in which the collection tray 90 moves up and down is a range of Lit range up to the upper surface of the apparatus frame 29. Generally, this Lit range is set at about 500 sheets to 1000 sheets as a collection amount of sheets, and in the case where sheets exceed the amount, the image formation apparatus A is halted to remove sheets placed on the collection tray 90 or to replace with a completely different sheet processing apparatus B capable of being externally installed on the apparatus frame 29.

Therefore, in the collection tray 90 according to the invention, an extension rack 140 capable of extending the up-and-down range with ease is added to the conventional up-and-down rack 110 (up-and-down rail 99), and FIG. 2 illustrates the sheet processing apparatus B that increases a sheet collection amount on the collection tray 90 and the image formation apparatus. The mechanism to extend will be described later, and by adding the extension rack 140 (extension rail 139), it is possible to increase the collection amount of sheets by about 500 sheets to 1000 sheets.

Herein, in order to add the extension rack 140 and enable the collection tray 90 to shift downward to the extension rack 140, first, the guide unit 30 having a length of L1*y* in the transport direction in FIG. 1 is replaced with the guide unit 30 having a length of L2*y* in the transport direction in FIG. 2. The length of L2*y* herein is to eliminate the distance L1*a* between the binding apparatus side surface and the side surface of the apparatus frame 29 in FIG. 1 and make a position in which the up-and-down rack 100 and the extension rail 139 are connected.

The mechanism for increasing the collection amount will be described below. Prior to the description, described are the folding unit 31 constituting apart of the sheet processing apparatus B in FIG. 1, the binding unit 32, the tray unit 33 installed in the unit 32, and an up-and-down mechanism of the collection tray 90 of the tray unit 33, and subsequently, the extension rail including the extension rack 140 will be described.

In addition, the guide unit 30 is shown as a unit for guiding transport of a sheet to adjust the length in the transport direction of the sheet processing apparatus B, and inside the unit, a punch unit for punching a hole in a sheet, stamp unit for putting a stamp and an emboss unit for adding concavities and convexities to a sheet may be disposed alone or in combination.

[Folding Unit 31]

Figure 3:
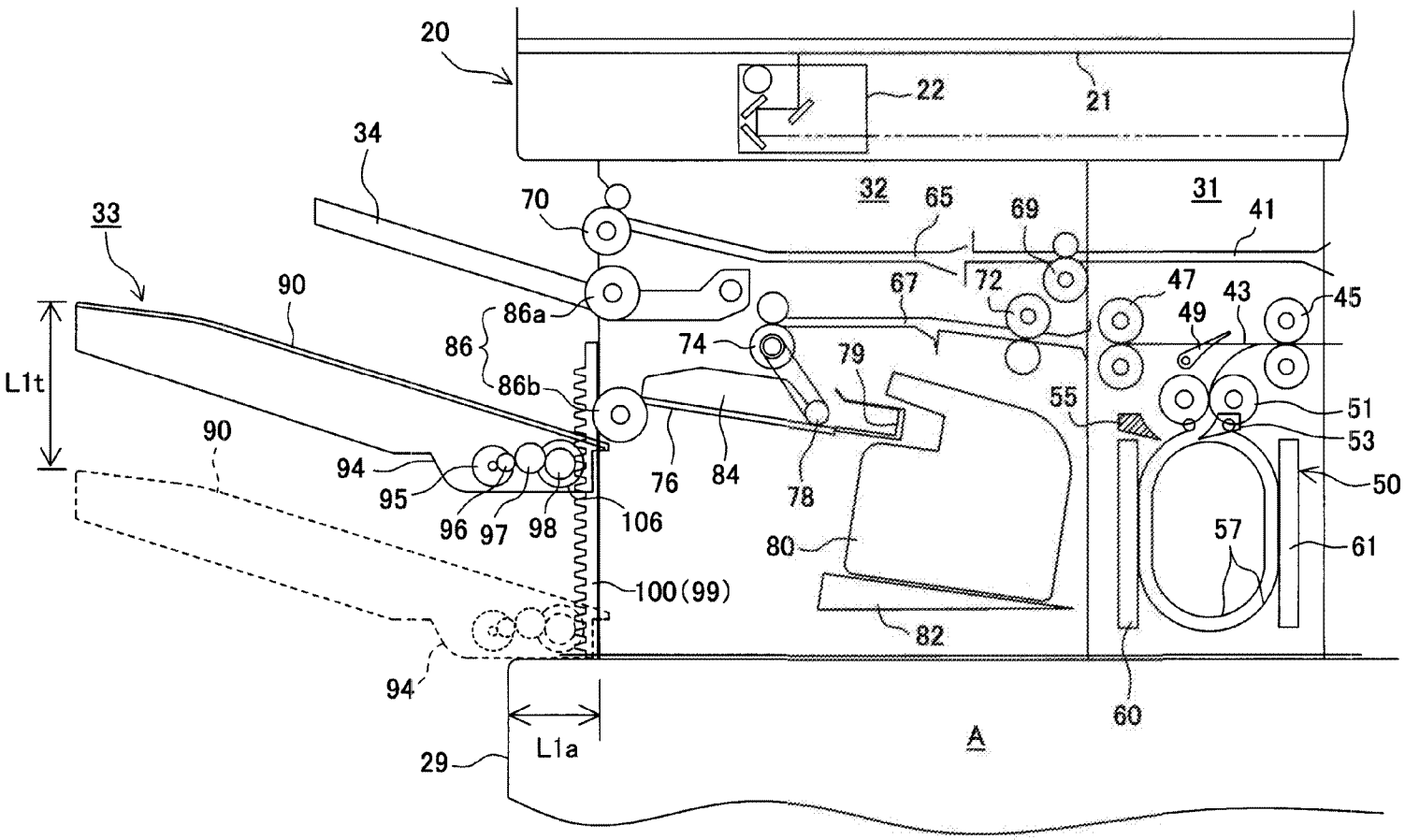
FIG. 3 is an explanatory view illustrating the discharge unit shown in FIG. 1.

FIG. 3 is an enlarged explanatory view of the folding unit 31, binding unit 32 and tray unit 33 installed in the unit 32 which are a part of the sheet processing apparatus B as the discharge unit of FIG. 1.

First, among paths continued to a switchback path 35 and a transport path 37 of the guide unit 30 from the main-body discharge outlet 16, in a folding transport path 43 in the lower stage are disposed an entrance roller 45 and exit roller 47. A switching flapper 49 is provided between the entrance roller 45 and the exit roller 47, and by the switching flapper 49, it is configured that folding processing is performed in a tube-shaped folding section 50 without transporting a sheet to the subsequent binding unit 32.

In addition, in the upper stage is provided a folding switchback path 41 connected to the guide unit 30 shown in FIGS. 1 and 2.

The tube-shaped folding section 50 enables a carry-in roller 51 that carries a sheet in the tube-shaped folding section 50, and first gates 53 and second gates 55 that determine a winding direction of a sheet with respect to the tube-shaped folding section to shift to actuation positions selectively. For example, by the first gate 53, a sheet is wound around a tube-shaped formation section 57 in a counterclockwise direction as viewed in the figure. The tube-shaped formation section 57 is formed of a deformable sheet member, and winds a sheet, for example, in a state in which three faces are overlapped. Then, in the state where the sheet is wound around the tube-shaped formation section, when shift members 60, 61 positioned on the opposite sides shift in mutually approaching directions, the wound sheet is also made a vertically flat shape. By pulling out the wound sheet with cylindrical rollers, not shown, in this state, the folded sheet is obtained.

[Binding Unit 32]

Successively, the binding unit 32 will be described which binds sheets transported from the folding unit 31, without performing folding processing in FIG. 3. Also in the binding unit 32, in the upper stage is provided a folding switchback path 65 connected to the folding switchback path 41, a transport roller 69 is disposed on the entrance side, and a discharge roller 70 is disposed on the exit side. The folding switchback path 65 functions as a path for switching back to the image formation section 2 to form an image on the backside, and when necessary, is also capable of discharging a sheet such as a thick sheet unsuitable for both sides or binding processing to an escape tray 34 positioned above the tray unit 33 with the discharge roller 70. In addition, as these paths for switchback, an upper cover of each unit may be used.

Below the binding switchback path 65 is provided a binding transport path 67 connected to the folding transport path 43 of the folding unit 31. On the entrance side of the binding transport path 67 is provided a carry-in roller 72, and on the exit side is provided a carrying-out roller 74 for discharging a sheet to the processing tray 76 or collection tray 90. When the sheet discharged from the carrying-out roller 74 is temporarily placed on the processing tray 76 as a bunch, a bunch discharge roller 86 that also functions for discharge of a bunch is rotated in a counterclockwise direction (direction of a reference surface 79) in a state of nipping the sheet, a take-in roller 78 that rotates in a counterclockwise direction in cooperation with the roller 78 is rotated, and the sheet is transported until the sheet comes into contact with the reference surface 79. Concurrently therewith, a pair of alignment plates 84 positioned in a sheet width direction of the processing tray 76 are brought into contact with the sheet side edges to align the sheet.

This operation is repeated until the number of sheets reaches the number of binding sheets, and when reaching the number of binding sheets, at this point, the stapler 80 is shifted to a predetermined position of a shift bench 82 to perform binding processing. A bunch of sheets with a designated portion subjected to the binding processing by the stapler 80 is discharged to the collection tray 90 by shifting the reference surface 79 not shown to the collection tray 90 side, and bringing an up-and-down bunch discharge roller 86*a* into press-contact with a lower bunch discharge roller 86*b* fixed to the discharge side of the processing tray 76.

[Tray Unit 33]

A bunch of sheets or each sheet discharged by the bunch discharge roller 86 is collected in the tray unit 33 having the collection tray 90 moving up and down. The collection tray 90 moves up and down by up-and-down pinions 98 of the collection tray 90 rotation-engaging in up-and-down racks 100 constituting a part of up-and-down rails 99 that are shift rails described later. The up-and-down pinion 98 is driven by an up-and-down motor 95 positioned in an up-and-down motor installation portion 94 below the collection tray 90 via a transmission gear 97 and the like.

As described already, the range of up-and-down of the collection tray 90 shown in FIG. 3 is the Lit range, because the sheet processing apparatus B including the binding unit 32 is positioned inside the body corresponding to L1*a* from the side portion of the apparatus frame 29.

[Collection Tray 90]

Figure 4:
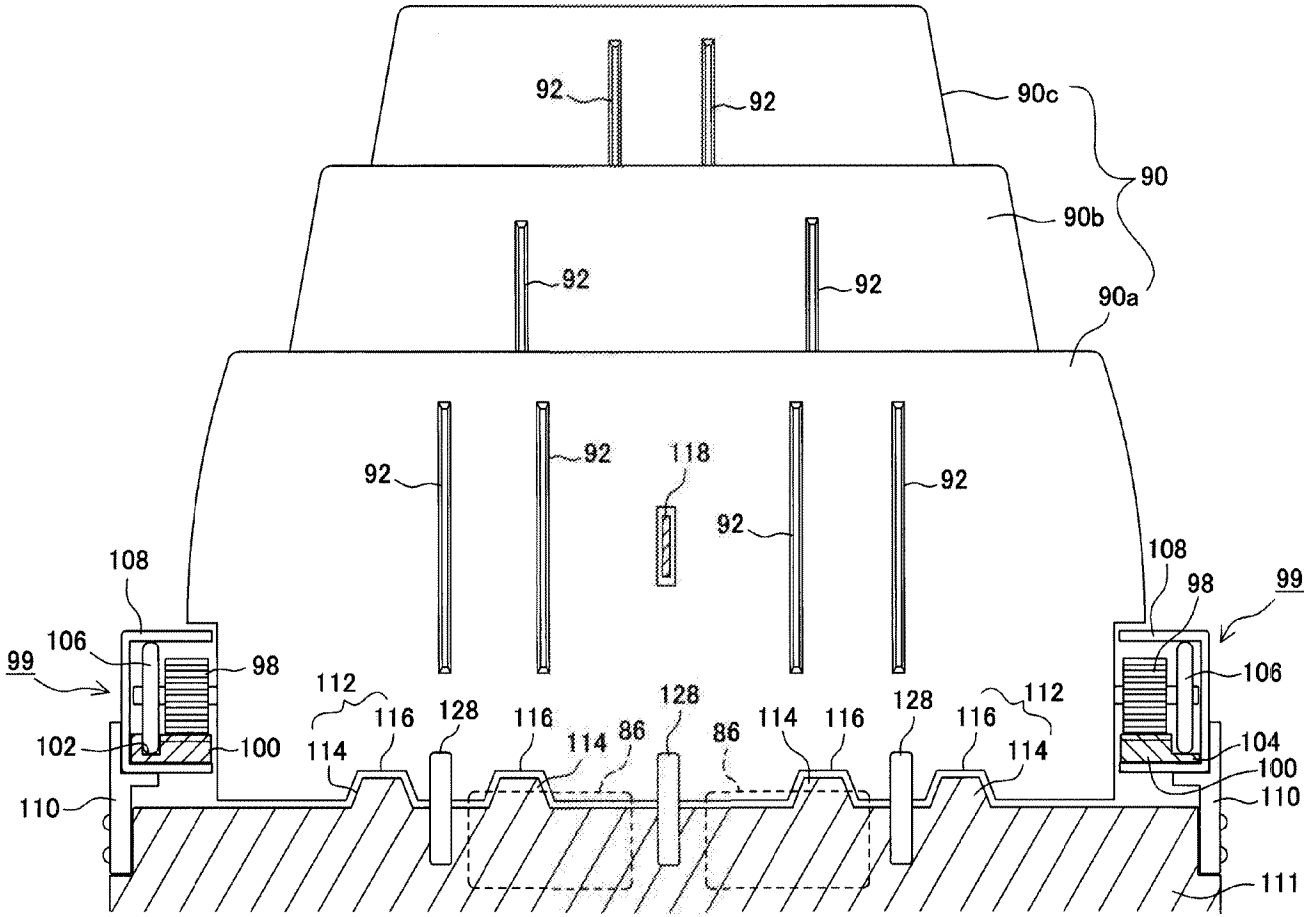
FIG. 4 is a plan view of the collection tray attached to the discharge unit of FIG. 3 to move up and down.
Figure 5:
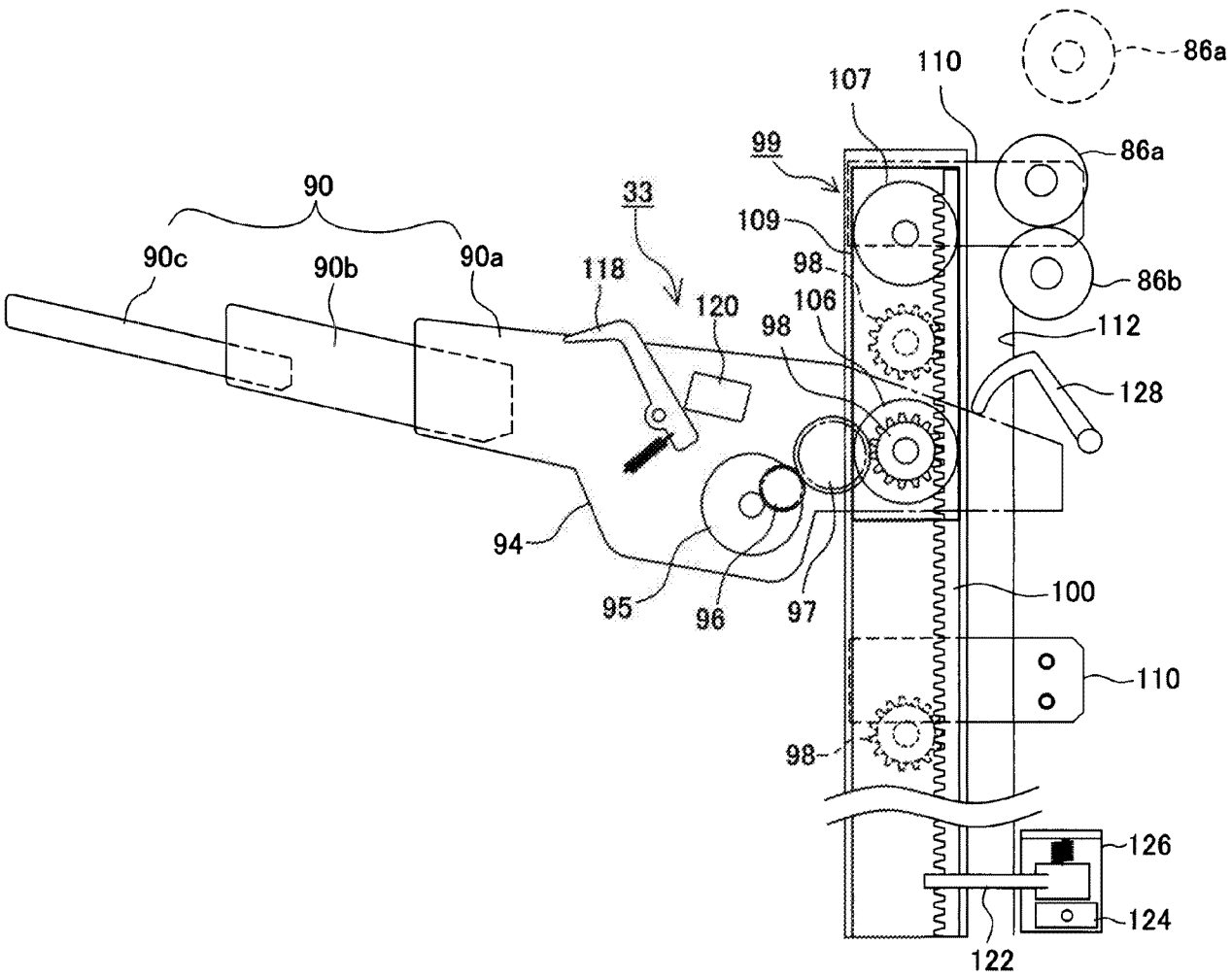
FIG. 5 is an up-and-down mechanism explanatory view of the collection tray attached to the discharge unit of FIG. 3.

Referring to FIGS. 4 and 5, described next is the up-and-down mechanism of the collection tray 90 which is attached to the sheet processing apparatus B that is the discharge unit of FIG. 3 and which moves up and down. FIG. 4 is a plan explanatory view of the collection tray 90 and is a cross-sectional explanatory view.

In the collection tray 90, a first auxiliary tray 90*b* and second auxiliary tray 90*c* are provided on the front end side to enable a main tray 90*a* to be pulled out corresponding to the length of the sheet to collect, and in each tray, ribs 92 to reduce slide resistance of the sheet are provided in appropriate positions. On the rear end side, a side wall of the binding unit 32 constituting a part of the sheet processing apparatus B as the discharge unit is a standing surface 112 that regulates a discharged sheet so that the discharged sheet drops under its own weight to be aligned. The standing surface 112 and the rear end of the collection tray 90 are formed in the shape of a comb so as to respectively have standing surface convex portions 114 and standing surface concave portions 116. The shape of a comb is to prevent a sheet from entering a gap between the standing surface 112 and the rear end portion of the collection tray 90 when the sheet is discharged by the bunch discharge roller 86 and collected in the collection tray 90, and to reduce slide resistance in sheet up-and-down.

[Up-and-Down Mechanism of the Collection Tray 90]

The up-and-down mechanism of the collection tray 90 will be described next. As shown in FIG. 4, in the opposite end portions in the sheet width direction of the collection tray 90, the up-and-down rails 99 are supported by binding unit attachment portions 110 fixed to the frame of the binding unit 32 constituting a part of the sheet processing apparatus B. In the up-and-down rail 99, the up-and-down rack 100 having a groove portion 102 is attached to a channel-shaped (U-shaped) support angle 108. Inside the support angle 108 are disposed the up-and-down pinion 98 driven to rotate by the up-and-down motor 95 of the collection tray 90 and a regulation pulley 106 joined rotatably on the same axis as that of the up-and-down pinion 98.

In the regulation pulleys 106, the upper part of the regulation pulley 106 on the left side in FIG. 4 contacts the support angle 108, the lower side enters into the groove portion 102 of the up-and-down rack 100, and right and left positioning is thereby made. On the other hand, in the regulation pulley 106 on the right side as viewed in FIG. 4, the upper side contacts the support angle 108, and the lower side also contacts a guide portion 104 of the up-and-down rack 100 to slide. Thus, the right regulation pulley 106 is in the groove portion 102, and the left regulation pulley 106 is in contact with the plane-shaped guide portion 104. This is because of eliminating difficulty in assembly caused by dimension errors when the right and left portions are groove portions.

The up-and-down rail 99 in FIG. 4 is checked in FIG. 5. The up-and-down pinion 98 and regulation pulley 106 provided on the same axis are positioned in the width direction of the collection tray 99, and an upper regulation pulley 107 is attached to the upper portion. The regulation pulley 106 and upper regulation pulley 107 are attached to a rectangular pulley support plate 109, and the pulley support plate 109 is attached to the base end portion of the collection tray 90 (in FIG. 4, the pulley support plate 109 is omitted.) By this means, the collection tray 90 is supported by two upper and lower points, and is not inclined when sheets are placed. As described previously, the up-and-down pinion 98 on the same axis as the regulation pulley 106 is driven to rotate by the up-and-down motor 95 of the up-and-down motor installation portion 94 via transmission gears 96, 97, and meshes with the up-and-down rack 100 to move up and down corresponding to the direction of driven rotation.

[Sensors of the Collection Tray 90]

In the collection tray 90 are provided an empty sensor 120 for detecting whether or not a sheet is placed on the collection tray 90, a limit sensor 124 for detecting that the collection tray 90 is positioned in the lower limit of the up-and-down rail 99, and a paper surface level sensor 130 for detecting a sheet placement amount by a paper surface height of sheets placed on the collection tray 90.

In the empty sensor 120, an empty flag 118 is provided rotatably substantially in the center in the width direction of the collection tray 90, rotates when a sheet is placed, and switches the empty sensor ON to detect.

In the limit sensor 124, a limit sensor flag 122 is pushed downward by the bottom of descending collection tray 90, and the limit sensor detects the flag, and thereby detects the lower limit position of the collection tray 90. In addition, the limit sensor 124 is made a unit together with the limit sensor flag 122 and a return spring that returns the flag as a limit sensor unit 126, and the unit is configured to be attachable and detachable to/from the apparatus frame. Accordingly, when the extension rail 139 is added to the up-and-down rail 99 described later, the limit sensor unit is removed to set so that the collection tray 90 is capable of further moving down.

Figure 6:
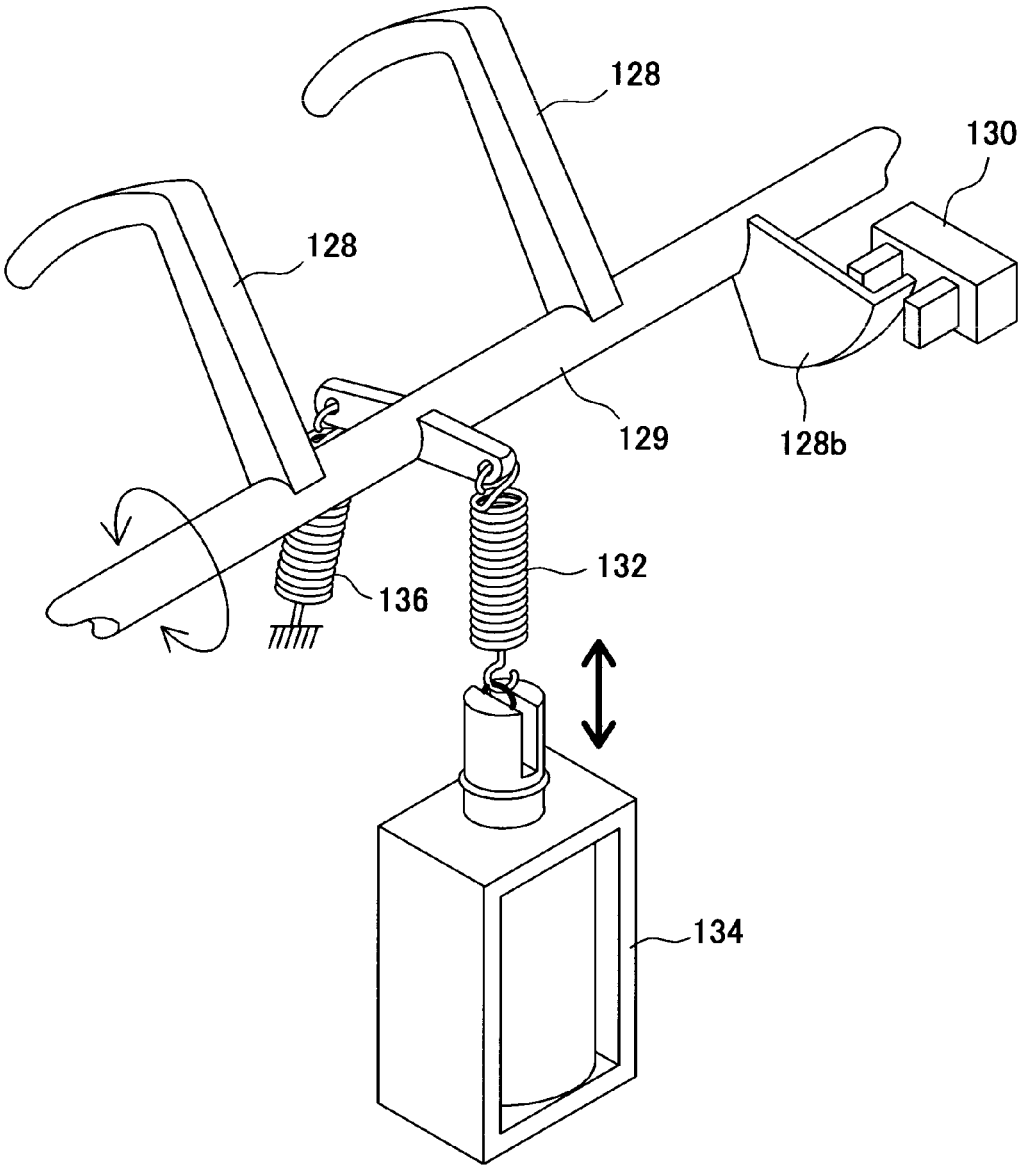
FIG. 6 is a mechanism explanatory view of a paper surface level sensor that detects a sheet placement amount of the collection tray.

FIG. 6 illustrates a mechanism of the paper surface level sensor 130 that detects a sheet load amount on the collection tray 90. As shown in the figure, paper surface level sensor flags 128 to contact the sheet on the collection tray 90 and a sensor-side flag **128*b* provided on the side opposite to the paper surface level sensor flag 128 to rotate integrally are provided on the back side of the standing surface 112 to be rotatable about a rotating shaft 129 as a shaft center. In the rotating shaft 129, one end is coupled to a solenoid 134 via an intermediate spring 132, and the other end is coupled to a return spring 136 provided in a tensioned state, for example, from the standing surface 112**.

Based on the above-mentioned mechanism, sheets are discharged from the bunch discharge roller 86, and the paper surface level sensor flag 128 rotates around the rotating shaft 129 by OFF of the solenoid and return spring 136 until the flag comes into contact with the sheet. In this contact state, the sensor-side flag **128*b* determines a detection state of the paper level sensor 130, and it is thereby possible to detect the paper surface level of the sheet placed on the collection tray 90. For example, in this Embodiment, in a state in which the solenoid 134 is OFF, when the sensor-side flag 128*b* is detected, it is determined that the paper surface level is proper, and when the flag 128*b* is not detected, the up-and-down motor 95 is driven to move the collection tray 90 down. This operation is repeated, and in the case where the above-mentioned limit sensor 124 is ON and the paper surface level sensor is ON when the solenoid is OFF, it is determined that sheets are in a full state on the collection tray 90**.

[Extension Rail Attachment (Before Starting the Descent)]

Hereinafter, referring to FIGS. 7 to 11, described is the extension rail that extends the up-and-down range of the collection tray according to the present invention described in FIG. 2.

In addition, in these figures, the folding unit 31 and binding unit 32 that are of the sheet processing apparatus B constituting the discharge unit are the same as in the previous descriptions, and therefore, descriptions herein are omitted.

Figure 7:
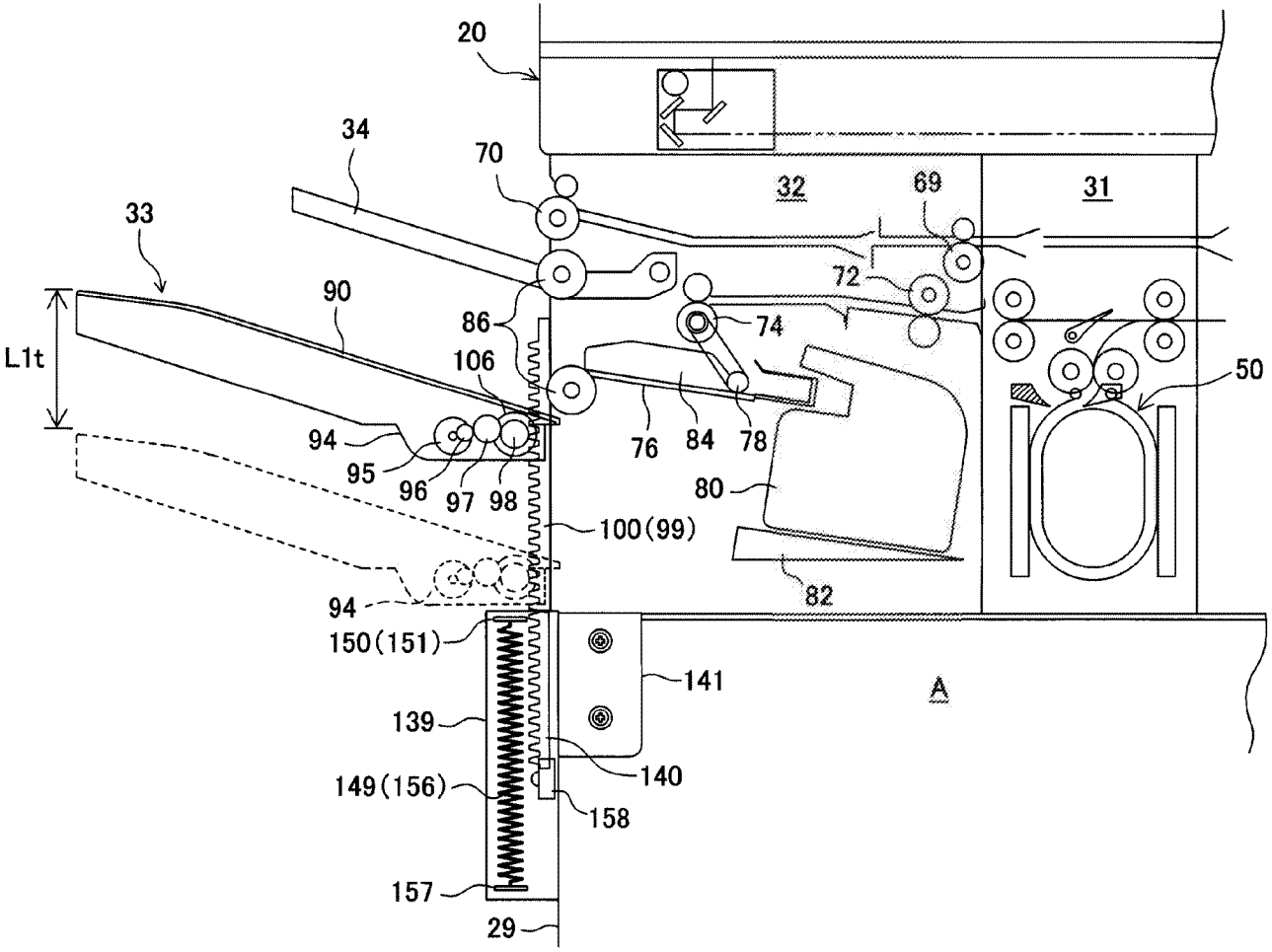
FIG. 7 is an explanatory view with an extension rail that extends an up-and-down range of the collection tray attached.

First, FIG. 7 illustrates a state in which the extension rail 139 including the extension rack 140 that extends the up-and-down range of the collection tray 90 is further added and set onto the conventional up-and-down rail 99 including the up-and-down rack 100. The extension rail 139 has an extension rail attachment portion 141 to fix to the apparatus frame 29 of the image formation apparatus A and the binding unit 32. The extension rail 139 is capable of being added and set onto the up-and-down rail 99 including the up-and-down rack 100.

In addition, the extension rail 139 may be attached to only the sheet processing apparatus B including the collection tray unit 33, and by thus configuring, since the need is eliminated to process the image formation apparatus main body side for attachment, such a configuration is more desirable.

Further, in the extension rail 139, since sheets to place on the collection tray 90 are increased to increase weight, when the collection tray 90 moves down on the extension rail 139, a load reduction member 149 comprised of a spring 156 to reduce the load on the up-and-down motor 95 is integrally provided inside the extension rail 139. These members will be described later, and the reason why the load reduction member 149 is provided is that the up-and-down motor 95 is set from the placement amount of sheets capable of being placed on the collection tray 90 that shifts within the Lit range of the up-and-down rail 99. By addition of the extension rail 139, the up-and-down range of the collection tray 90 is expanded to the L2*t* range, the sheet placement amount is increased to increase the load, and the setting is made to enable the collection tray 90 to move up and down without exchanging the up-and-down motor 95 when the load is increased.

As a matter of course, the up-and-down motor 95 of a large size may be used from the beginning when the extension rail 139 is scheduled to add and set, or the up-and-down motor 95 may be exchanged when the extension rail 139 added, but it is desirable that it is possible to use the conventional up-and-down motor 95.

FIG. 7 illustrates a state immediately before the collection tray 90 shifts to the extension rail 139 provided with the load reduction member 149, and the spring 156 of the load reduction member 149 is not compressed yet.

Figure 8:
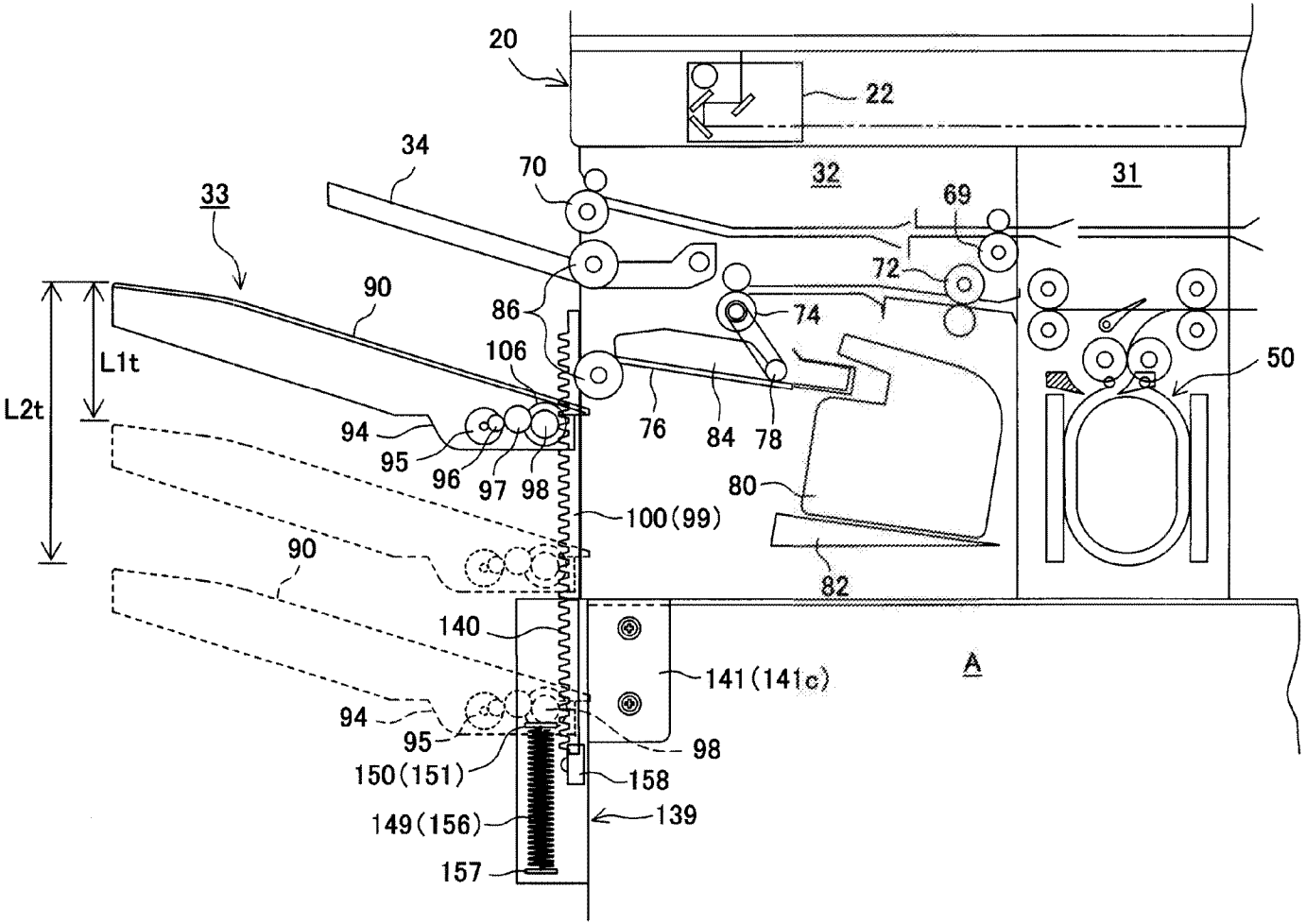
FIG. 8 is an explanatory view where the collection tray moves down on the extension rail.

FIG. 8 illustrates a state in which the collection tray 90 moves down on the extension rail 139 and is positioned on the lower end of the extension rack 140. In this state, the up-and-down pinion 98 of the collection tray 90 meshes with the extension rack 140 of the extension rail 139 to move down. In this position, the sheet load amount on the collection tray 90 is increased, and corresponding thereto, the load on the collection tray 90 is also increased. In this position, the spring 156 constituting the load reduction member described previously is compressed, and acts to reduce the load in the upward direction. By this means, even the conventional up-and-down motor 95 is capable of performing up-and-down operation sufficiently.

In addition, on the lower end of the extension rack 140 is provided an extension limit sensor unit 158 indicating that the collection tray 90 exits at the lower limit of the extension rack 140. The extension limit sensor unit 158 may be replaced with the limit sensor unit 126 of the up-and-down rail 99 described previously, or the limit sensor unit 126 may be removed to set a new sensor unit as the extension limit sensor unit 158.

[Extension Rail Internal Configuration]

Figure 9B:
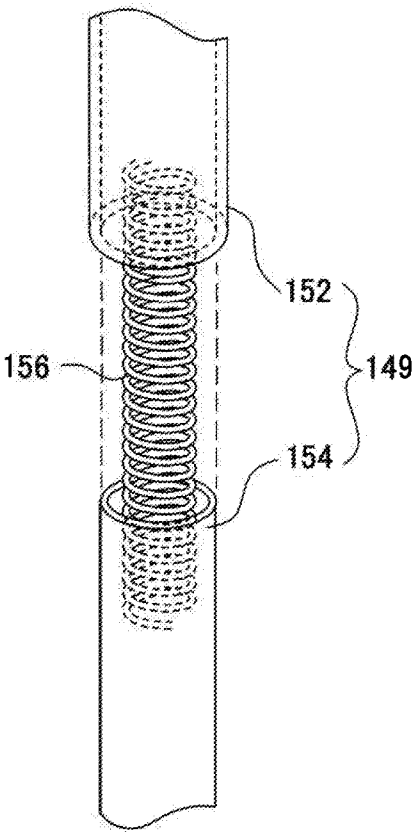
FIGS. 9A and 9B contain explanatory views of the extension rail of FIGS. 7 and 8, where
Figure 9A:
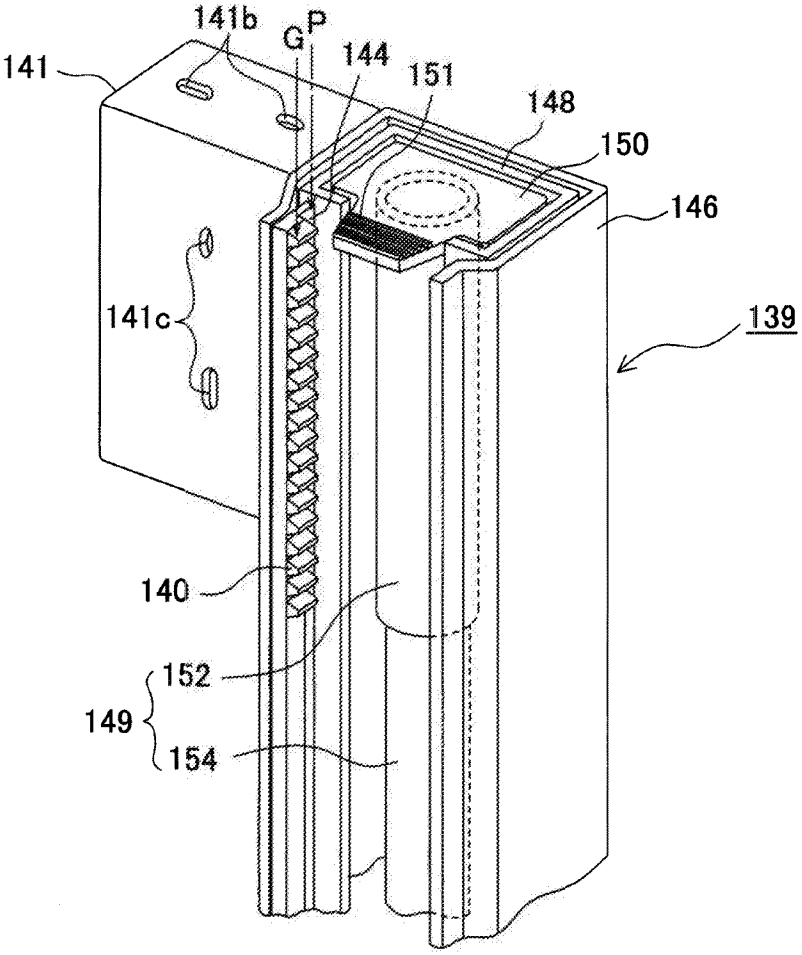

Referring to FIGS. 9A and 9B, described herein are an internal mechanism of the extension rail 139 described in FIGS. 2, 7 and 8 and the load reduction member 149 incorporated into the extension rail 139. FIG. 9A illustrates the internal mechanism of the extension rail 139, and the mechanism is comprised of an outer angle 146 having the extension rail attachment portion 141 to attach to the image formation apparatus A and the binding unit 32, and an inner angle 148, on the inner side thereof, provided with the load reduction member 149 with the spring 156 integrated.

In addition, as shown in the figure, the extension rail attachment portion 141 has binding unit attachment portions 141*b* to screw into the bottom of the binding unit 32, and frame attachment portions 141*c* to screw into the apparatus frame of the image formation apparatus A.

The outer angle 146 is set for an up-and-down pinion engagement position shown by the arrow G in which the up-and-down pinion 98 moving down from the up-and-down rail 99 engages, and a regulation pulley engagement position shown by the arrow P in which the regulation pulley 106 engages. In other words, the up-and-down pinion 98 meshes with the extension rail 140 in the position of the arrow G to allow ascent/descent. Further, in the position of the arrow P adjacent thereto, the regulation pulley 106 and upper regulation pulley 107 mainly shown in FIGS. 4 and 5 undergo slide regulation between an extension guide portion 144 of the extension rack 140 and the outer angle 146 to hold ascent/descent.

Thus, the up-and-down pinion engagement position G and the regulation pulley engagement position are positioned and attached to communicate with the up-and-down rail 99, and the collection tray 99 is thereby capable of moving up and down in a range extended from the up-and-down rail 99 to the extension rail 139.

Further, in the present invention, in the inner angle 148, the spring 156 is disposed as the load reduction member 149 over the entire length of the extension rail 139. As shown in FIG. 9B, the spring 156 is held by cylindrical outer slider 152 and inner slider 154 that mutually slide and is capable of performing compression operation smoothly. Further, as shown in FIG. 9A, in the outer slider, an upper receiving portion 150 is disposed in the upper portion, and a receiving portion as shown in FIGS. 7 and 8 is disposed in the lower portion. A collection tray receiving bench 151 that receives the bottom portion of the collection tray 90 has the upper receiving portion 150.

Accordingly, when the collection tray 90 moves down on the extension rail 139 (extension rack 140), the collection tray receiving bench 151 comes into contact with the bottom portion of the collection tray 90, and the spring 156 acts to reduce the load of sheets placed on the collection tray 90. By this means, it is possible to use the up-and-down motor 95 driven to move up and down only on the up-and-down rail 99 without modification.

[Modifications of Extension Rail Attachment]

Described next are Modifications of the method of attaching the extension rail 139 to the image formation apparatus A and the sheet processing apparatus B including the binding unit 32. In attachment in the foregoing, the extension rail attachment portion 141 is to screw and attach to each of the bottom of the binding unit 32 and the apparatus frame of the image formation apparatus A.

Figure 10B:
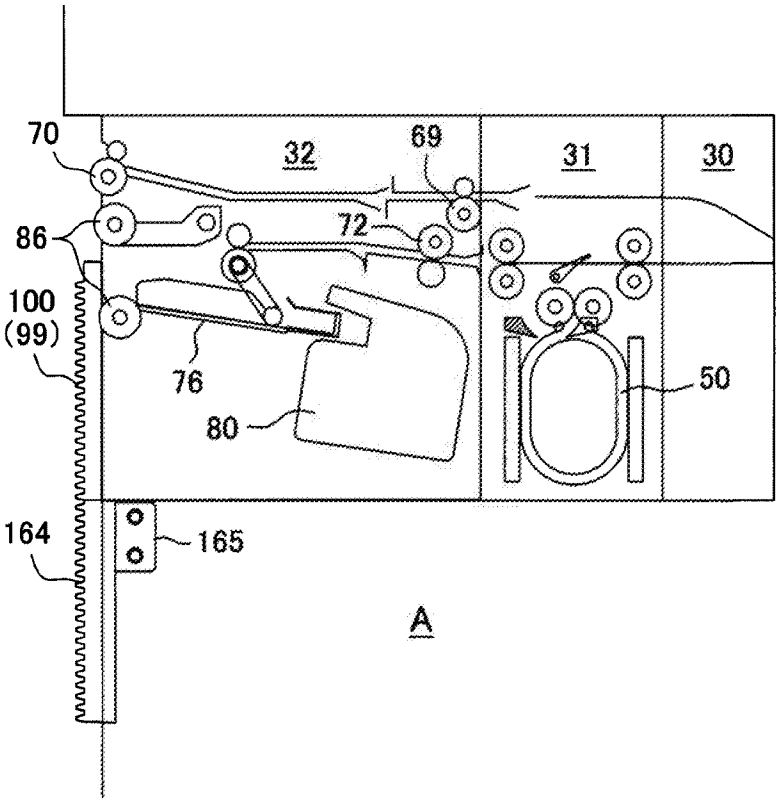
FIGS. 10A and 10B illustrate modifications of attachment of the extension rail, where
Figure 10A:
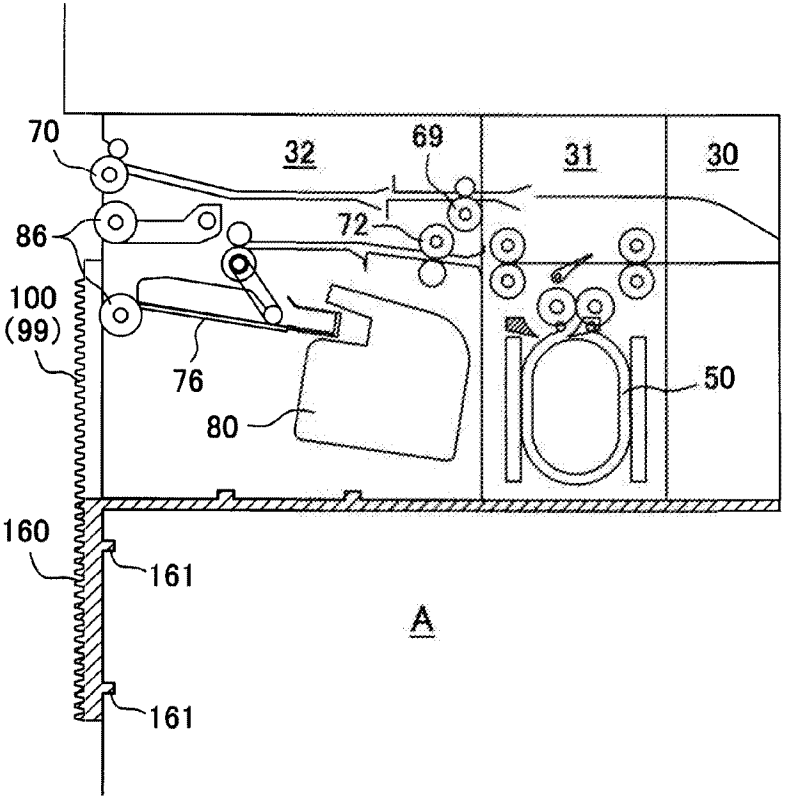

In contrast thereto, in FIG. 10A, the rail is fitted into concave portions of the binding unit 32 of the sheet processing apparatus B constituting the discharge unit to attach. In this manner, the attachment portion and extension rail are made substantially in the shape of an L, convex portions of the L-shaped extension rail 160 are fitted into concave portions of the bottom of the binding unit and the apparatus frame of the image formation apparatus A, and it is thereby possible to add and set the L-shaped extension rail 160 with ease.

Further, in FIG. 10B, the extension rail is attached to only the apparatus frame of the image formation apparatus A. In other words, an attachment portion 165 of a main-body fix extension rail 164 is screwed into only the apparatus frame 29 of the image formation apparatus A to add and set the main-body fixe extension rail 164. In this way, only by shifting the sheet processing apparatus B including the binding unit 32 to a position coinciding with the side surface of the apparatus frame 29 of the image formation apparatus A (slide shift corresponding to the distance of L1*a* in FIG. 1 or 3), it is possible to extend the up-and-down range of the collection tray 90 to the main-body fix extension rail 164.

In addition, in the mechanism as described up to FIGS. 9A and 9B, the shift range of the up-and-down motor 95 is set by adding the extension rail 139 and switching an extension rail addition switch 143. Further, it is possible to automatically extend the shift range to move up and down, by setting so as to detect a shift (slide shift corresponding to the distance of L1*a* in FIG. 1 or 3) that the sheet processing apparatus B has shifted to a position coinciding with the side surface of the apparatus frame 29, and extend the up-and-down range of the collection tray 90 by the up-and-down motor 95.

[Description of a Control Configuration]

Figure 11:
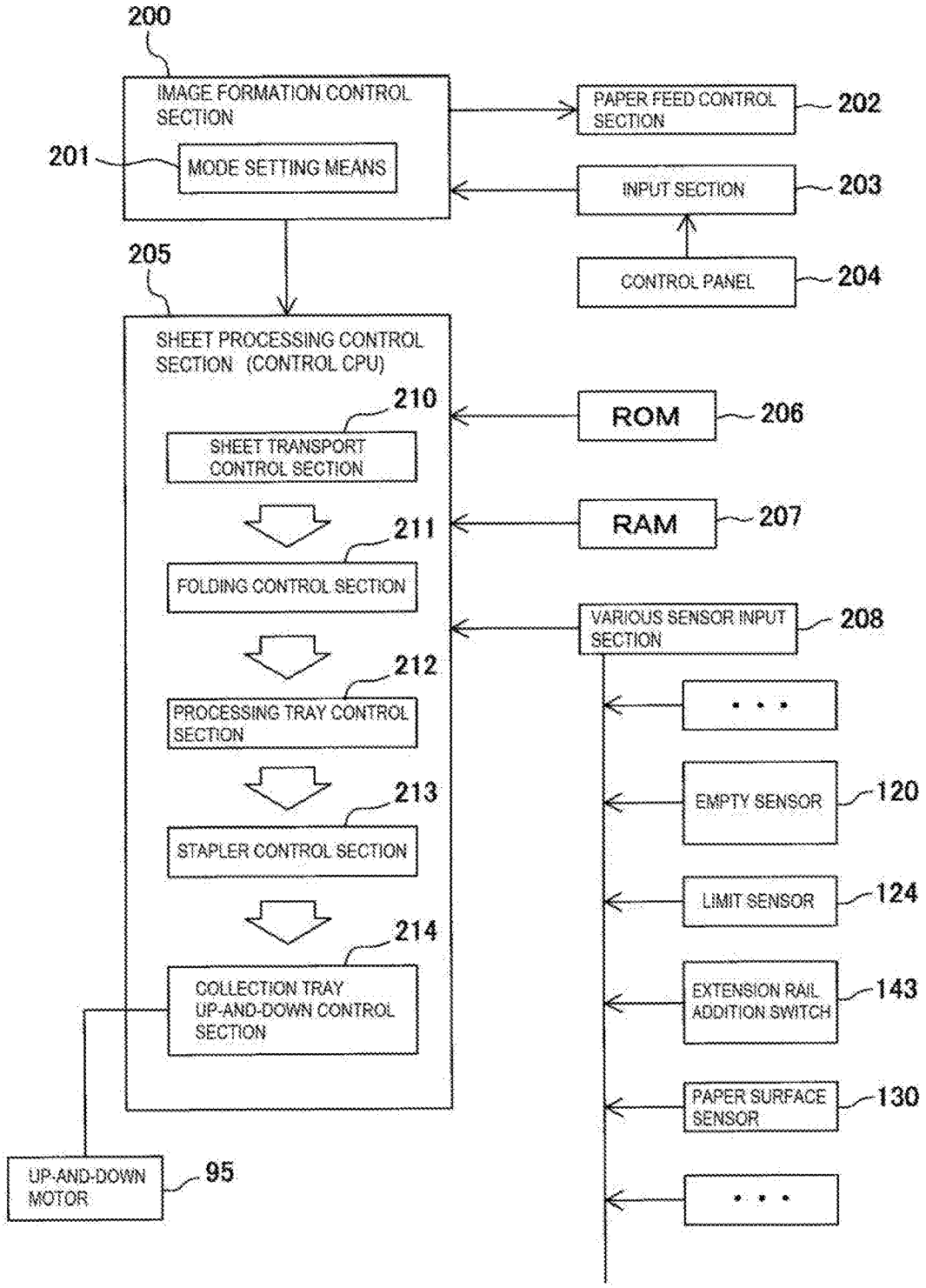
FIG. 11 is an explanatory view of a control configuration in the entire configuration of FIG. 2.

A system control configuration of the image formation apparatus A provided with the above-mentioned sheet processing apparatus B will be described according to a block diagram of FIG. 11. An image formation apparatus system shown in FIG. 1 is provided with an image formation control section 200 of the image formation apparatus A and a sheet processing control section 205 (control CPU) of the sheet processing apparatus B including the guide unit 30, folding unit 31, binding unit 32 and tray unit 33. The image formation control section 200 is provided with a paper feed control section 202 and input section 203. Then, from a control panel 204 provided in the input section 203 is performed setting of a sheet processing mode such as "print mode", "sheet folding mode" and "sheet binding mode" described later.

The sheet processing control section 205 is a control CPU that operates the sheet processing apparatus B corresponding to the designated sheet processing mode as described previously. The sheet processing control section 205 is provided with ROM 206 storing operation programs, and RAM 207 storing control data. Further, to the sheet processing control section 205 are input signals from a various sensor input section 208 of a sheet sensor (not shown) that detects a transported sheet, and in relation to the collection tray 90, the empty sensor 120 that detects whether or not a sheet is placed on the collection tray 90, the limit sensor 124 that detects a descent lower limit position of the collection tray 90, the paper surface level sensor 130 that detects a paper surface level so as to detect a sheet load amount on the collection tray 90, and the like.

Further, when the extension rail 139 is added and set as described in the foregoing, while causing the sheet processing control section to recognize, the various sensor input section 208 is provided with the extension rail addition switch 143.

The extension rail addition switch 143 may automatically detect that the sheet processing apparatus shifts to a position along the apparatus frame 29, or may be switched manually.

In addition, without providing the extension rail addition switch 143, in the case of only the up-and-down rail 99, the limit sensor unit 126 to detect the lower limit position of the collection tray 90 is removed, and by instructing from the control panel 204 described later to move the collection tray 90 down until the extension limit unit sensor 158 detects, the section recognizes that the extension rail 139 is laid to expand the descent range.

In order to more confirm the setting of the extension rail 139, as well as the above-mentioned instruction, when the extension rail addition switch 143 is provided, the setting of the extension rail 139 is recognized more reliably. Alternatively, it may be recognized that the extension rail 139 is laid only by input of the extension rail 139 addition switch 143, and it is only required that expansion of the up-and-down range of the collection tray 90 is capable of being recognized by any form.

In addition, the sheet processing control section 205 is provided with a sheet transport control section 210 that controls sheet transport of each unit of the guide unit 30, folding unit 31, binding unit 32 and tray unit 33. Further, the sheet processing control section 205 is provided with a folding control section 211 that performs sheet folding processing in the folding unit 31, a processing tray control section 212 that controls the alignment plates 84 and the like in placing on the processing tray 76 to perform binding in the binding unit 32, and a stapler control section 213 that controls the stapler 80 that performs binding processing on a bunch of sheets placed on the processing tray 76.

Further, the sheet processing control section 205 is provided with a collection tray up-and-down control section 214 that controls the up-and-down motor 95 for ascent/descent of the collection tray 90 as described in the foregoing, based on detection signals from the empty sensor 120, paper surface level sensor 130, limit sensor 124 and the like.

[Sheet Processing Mode]

The sheet processing control section 205 of this Embodiment configured as described above causes the sheet processing apparatus B to execute, for example, the "print mode", "sheet folding mode", "sheet binding mode" and the like. The processing mode will be described below.

(1) "Print-Out Mode"

An image-formed sheet is received from the main-body discharge outlet 16 of the image formation apparatus A, and the sheet is stored on the collection tray 90 on a sheet-by-sheet basis with the bunch discharge roller 86 via the carry-in roller 72 and carrying-out roller 74.

(2) "Sheet Folding Mode"

A sheet from the transport path 37 of the guide unit 30 is transported to the tube-shaped folding section of the folding unit 31 to perform simple sheet folding, and the folded sheet is discharged to the apparatus front side crossing the sheet transport direction of the transport path 37.

(3) "Sheet Binding Mode"

Image-formed sheets from the main-body discharge outlet 16 are temporarily placed as a bunch on the processing tray 76 of the binding unit 32 via the guide unit 30 and folding unit 31, and this bunch is bound by the stapler 80, and is then collected on the collection tray 90.

According to the Embodiments to carry out the invention as described above, the following effects are exhibited.

1. Provided is the sheet collection apparatus provided with the collection tray 90 for receiving a discharged sheet and shifting, the discharge unit (binding unit 32 constituting a part of the sheet processing apparatus B) for discharging a sheet, a shift rail (up-and-down rail 99 including the up-and-down rack 100) that is provided in the discharge unit and that permits a shift of the collection tray corresponding to a sheet collection amount of the collection tray, a drive member (up-and-down motor 95) that shifts the collection tray along the shift rail, and the extension rail 139 capable of being added and set onto the shift rail to extend a shift range of the collection tray.

According to the apparatus, by setting the extension rail that extends the shift range of the collection tray on the shift rail that permits a shift of the collection tray, it is possible to expand the range of a shift of the collection tray relatively with ease to increase the collection amount of sheets.

2. Provided is the sheet collection apparatus, where the drive means (up-and-down motor 95) is controlled by a control section (collection tray up-and-down control section 214) to shift beyond the shift rail, when it is recognized that the extension rail 139 is added.

According to the apparatus, by recognizing that the extension rail is laid, it is possible to make expansion of the shift range of the collection tray 90 with ease.

3. Provided is the sheet collection apparatus as described in above-mentioned item 1, where the extension rail 139 is provided with the load reduction member 149 (spring 156) that reduces a load of the collection tray for receiving a sheet and shifting.

According to the apparatus, it is possible to use the conventional up-and-down motor 95, without replacing the up-and-down motor 95 with a motor of a large size.

4. Provided is the sheet collection apparatus as described in above-mentioned item 3, where the shift rail (up-and-down rail 99) and the extension rail 139 are respectively comprised of a gear (up-and-down pinion 98) constituting a part of the drive member provided on the collection tray side, a rack (extension rail 99, extension rack 140) that engages in the gear, and a slide rail (support angle 108, outer angle 146) that slide-holds the collection tray, and the load reduction member 149 is comprised of a compression spring (spring 156) that receives a load of the collection tray.

According to the apparatus, only by connecting the extension rail to the shift rail, it is possible to extend the shift range of the collection tray 90 with ease, and the need is eliminated for upsizing the up-and-down motor 95.

5. Provided is an image formation apparatus having the collection tray 90 for receiving a discharged sheet and shifting provided with the apparatus frame 29 having the image formation section 2, the discharge unit (sheet processing apparatus B including the binding unit 32) that is disposed above the image formation section and that performs processing on a sheet subjected to image formation from the apparatus frame to discharge, the shift rail (up-and-down rail 99) attached to the discharge unit to support a shift of the collection tray that shifts corresponding to a collection amount of discharged sheets, the drive member (up-and-down motor 95) attached to the collection tray to shift the collection tray along the shift rail, and the extension rail 139 capable of being added and set onto the apparatus frame to extend a shift range of the collection tray, where the discharge unit is configured to be able to shift to a first position (position on the inner side than the side surface of the apparatus frame 29 by L1*a*) to shift the collection tray in a range of the shift rail, and a second position (substantially the same position as the side surface of the apparatus frame 29) shifted to a sheet discharge direction to enable the collection tray to shift in a range in which the shift rail and the extension rail are continued, above the image formation section, and when the discharge unit is shifted to the second position, the collection tray is capable of shifting between the shift rail and the extension rail.

According to the apparatus, by adding the extension rail 139 and shifting the discharge unit (sheet processing apparatus B including the binding unit 32) to the position along the side surface of the apparatus frame 29, it is possible to expand the shift range of the collection tray relatively with ease to increase a collection amount of sheets.

6. Provided is the image formation apparatus as described in above-mentioned item 5, where in order to reduce a load of the collection tray 90 for receiving a sheet and shifting, the extension rail 139 is provided with a spring member (spring 156) that comes into contact with the collection tray 90 during a shift of the collection tray 90 to reduce a load of the collection tray 90.

According to the apparatus, without replacing the up-and-down motor 95 with a motor of a large size, it is possible to use the conventional up-and-down motor 95.

7. Provided is the image formation apparatus as described in above-mentioned item 6, where the extension rail 139 and the spring member (spring 156) are made a unit.

According to the apparatus, only by adding and setting the extension rail, it is possible to execute reduction in the load of the collection tray 90.

8. Provided is the image formation apparatus as described in above-mentioned item 5, where the extension rail 139 is beforehand attached to a side portion of the apparatus frame 29.

According to the apparatus, the extension rail is attached to the apparatus frame, and it is thereby possible to expand the shift range when necessary.

9. Provided is the image formation apparatus as described in above-mentioned item 5, where the extension rail 139 is attached to the discharge unit additionally.

According to the apparatus, by attaching to the discharge unit in shifting the discharge unit, it is possible to expand the shift range of the collection tray.

10. Provided is an image formation apparatus, where the extension rail is comprised of a slide rail (outer angle 146) that holds the collection tray 90 to enable a shift, and an extension rack 140 that meshes with a drive gear (up-and-down pinion 98) provided in the collection tray to shift the collection tray.

According to the apparatus, only by adding and setting the slide rail (outer angle 146) and extension rack 140 constituting the extension rail 139, it is possible to extend the shift range of the collection tray to increase a collection amount of sheets.

In addition, in the description of the effects in the Embodiments in the foregoing, for each portion of the Embodiment, the member corresponding to each component in the scope of the claims is shown in the parenthesis, or assigned the reference numeral to clarify the relationship between both the portion and the component.

Further, the present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2015-213814 filed on Oct. 30, 2015 in Japan, incorporated herein by reference.

The invention claimed is:

1. A sheet collection apparatus including a collection tray for receiving a discharged sheet and shifting, comprising:

a discharge unit adapted to discharge a sheet;

a shift rail provided in the discharge unit to permit a shift of the collection tray corresponding to a sheet collection amount of the collection tray;

a drive member adapted to shift the collection tray along the shift rail; and an extension rail capable of being added and set onto the shift rail to extend a shift range of the collection tray, wherein the extension rail is provided with a load reduction member that reduces a load of the collection tray for receiving a sheet and shifting.

2. The sheet collection apparatus according to claim 1, wherein each of the shift rail and the extension rail is comprised of a gear constituting a part of the drive member provided in the collection tray, a rack that engages in the gear, and a slide rail that slide-holds the collection tray, and the load reduction member is comprised of a compression spring that receives a load of the collection tray.

3. The sheet collection apparatus according to claim 1, further comprising a limit sensor to detect a shift limit position of the collection tray.

4. An image formation apparatus including a collection tray for receiving a discharged sheet and shifting, comprising:

an apparatus frame including an image formation section;

a discharge unit disposed above the image formation section, the discharge unit performing processing on a sheet subjected to image formation from the image formation section to discharge;

a shift rail attached to the discharge unit to support a shift of the collection tray that shifts corresponding to a collection amount of discharged sheets;

a drive member attached to the collection tray to shift the collection tray along the shift rail;

an extension rail capable of being added and set onto a side portion of the apparatus frame to extend a shift range of the collection tray; and a control unit for controlling the shift of the collection tray, wherein the discharge unit is configured to be able to shift to a first position to shift the collection tray in a range of the shift rail, and a second position shifted to a sheet discharge direction to enable the collection tray to shift in a range in which the shift rail and the extension rail are continued along the side portion of the apparatus frame, above the image formation section, and when the discharge unit is shifted to the second position along the side portion of the apparatus frame, the control unit detects the shift of the discharge unit, and controls the collection tray to be capable of shifting in the shift range extended from the shift rail to the extension rail.

5. The image formation apparatus according to claim 4, wherein in order to reduce a load of the collection tray for receiving a sheet and shifting, the extension rail is provided with a spring member that comes into contact with the collection tray during a descent of the collection tray to reduce a load of the collection tray.

6. The image formation apparatus according to claim 5, wherein the extension rail and the spring member are made a unit.

7. The image formation apparatus according to claim 4, wherein the extension rail is beforehand attached to the side portion of the apparatus frame.

8. The image formation apparatus according to claim 4, wherein the extension rail is attached to the discharge unit additionally.

9. The image formation apparatus according to claim 4, wherein the extension rail is comprised of a slide rail that holds the collection tray to enable a shift, and an extension rack that meshes with a drive gear provided in the collection tray to shift the collection tray.

10. The image formation apparatus according to claim 5, further comprising a limit sensor to detect a shift limit position of the collection tray.

* * * * *